US011536528B2

(12) United States Patent
Lewis et al.

(10) Patent No.: US 11,536,528 B2
(45) Date of Patent: Dec. 27, 2022

(54) EXTRACTION POLE ASSEMBLY FOR EXTRACTING PROJECTILES FROM A BORE

(71) Applicant: Raytheon Company, Waltham, MA (US)

(72) Inventors: Parker Lewis, Benson, AZ (US); Douglas J. Eliason, St. David, AZ (US); Mark A. Scott, Vail, AZ (US)

(73) Assignee: Raytheon Company, Waltham, MA (US)

( * ) Notice: Subject to any disclaimer, the term of this patent is extended or adjusted under 35 U.S.C. 154(b) by 43 days.

(21) Appl. No.: 16/739,080

(22) Filed: Jan. 9, 2020

(65) Prior Publication Data

US 2021/0215449 A1 Jul. 15, 2021

(51) Int. Cl.
*F41A 15/22* (2006.01)

(52) U.S. Cl.
CPC ..... *F41A 15/22* (2013.01)

(58) Field of Classification Search
CPC ..... F41A 5/08; F41A 5/20; F41A 5/22; F16B 7/042; E04H 7/20
USPC ..... 81/3.05; 42/95
See application file for complete search history.

(56) References Cited

U.S. PATENT DOCUMENTS 358,304 A * 2/1887 Simpson ..... F41A 29/02 15/147.1
543,652 A * 7/1895 Palm ..... F41A 15/22 81/3.05
1,665,988 A * 4/1928 Smith ..... F41A 29/02 15/104.165
3,716,884 A * 2/1973 Lavins ..... F41A 29/02 42/95
3,731,587 A 5/1973 Digiacomo
3,750,262 A 8/1973 Taylor, III
4,586,844 A * 5/1986 Hammonds ..... E04G 7/20 182/178.3
4,597,472 A * 7/1986 Hjelm ..... E04G 1/12 182/178.6
5,836,099 A * 11/1998 Pace ..... F41A 29/02 42/95
7,861,639 B1 1/2011 Trybulski et al.
(Continued)

FOREIGN PATENT DOCUMENTS

FR 2975178 B1 4/2013
GB 734641 A 8/1955
(Continued)

*Primary Examiner* — Bret Hayes

(57) ABSTRACT

An extraction system for removing an object from a bore, the extraction system comprising an extraction pole assembly comprising a plurality of extraction poles, each extraction pole having a proximal end and a distal end; and a plurality of centering couplers, each centering coupler of the plurality of centering couplers comprising a partial spherical outer surface sized to complement a diameter of the bore, a proximal end configured to couple to a distal end of an extraction pole, and a distal end configured to couple to a proximal end of the extraction pole. The extraction pole assembly can be operable with a press assembly comprising a clamp configured to secure to the structure having the bore, and an extendable member configured to provide an input force to an extraction pole of the extraction pole assembly.

21 Claims, 7 Drawing Sheets

(56) References Cited

U.S. PATENT DOCUMENTS

| | | | | |
|---|---|---|---|---|
| 2010/0008715 | A1* | 1/2010 | Minowa | F16B 7/042 403/203 |
| 2012/0132549 | A1* | 5/2012 | Dewey | B08B 9/00 206/223 |
| 2013/0198983 | A1* | 8/2013 | Frederick | F41A 15/22 15/104.16 |
| 2015/0176939 | A1* | 6/2015 | Thalmann | F41A 29/02 42/95 |
| 2017/0363399 | A1 | 12/2017 | Berger | |
| 2019/0350353 | A1* | 11/2019 | Borsari | A46D 1/0207 |
| 2020/0018080 | A1* | 1/2020 | Steck | E04G 1/30 |

FOREIGN PATENT DOCUMENTS

| | | | |
|---|---|---|---|
| RU | 2254538 | C1 | 6/2005 |
| RU | 2003136237 | A | 7/2005 |

* cited by examiner

EXTRACTION POLE ASSEMBLY FOR EXTRACTING PROJECTILES FROM A BORE

BACKGROUND

Artillery projectiles, such as "guided" projectiles comprising complex guidance systems, are becoming increasingly sophisticated and expensive. In view of the high cost of a projectile, it is increasingly important to recover any unused projectiles that are not fired, or during field testing. For example, a projectile may be loaded into a barrel of a projectile firing device, but not subsequently fired, such as is the case during field testing situations. In such instances, the projectile should be removed from the breech such that it can be used at a later time. However, the projectile often fits snuggly within the breech and cannot be easily removed.

Various methods have been used in the past to remove projectiles from the breech. The prior methods have included dropping a weight down an inclined barrel to dislodge the projectile and inserting a push rod in the barrel and pressing the push rod with either a hydraulic jack or hitting the push rod with a hammer to dislodge the projectile. While the previous attempts were typically successful in removing the projectile from the breech, they have several potential shortcomings. For example, the dropped weight could damage the rifling of the barrel or damage the projectile. Similarly, the push rod can damage the projectile, or the push rod can bend, binding in the barrel and potentially damaging the inner surface of the barrel.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
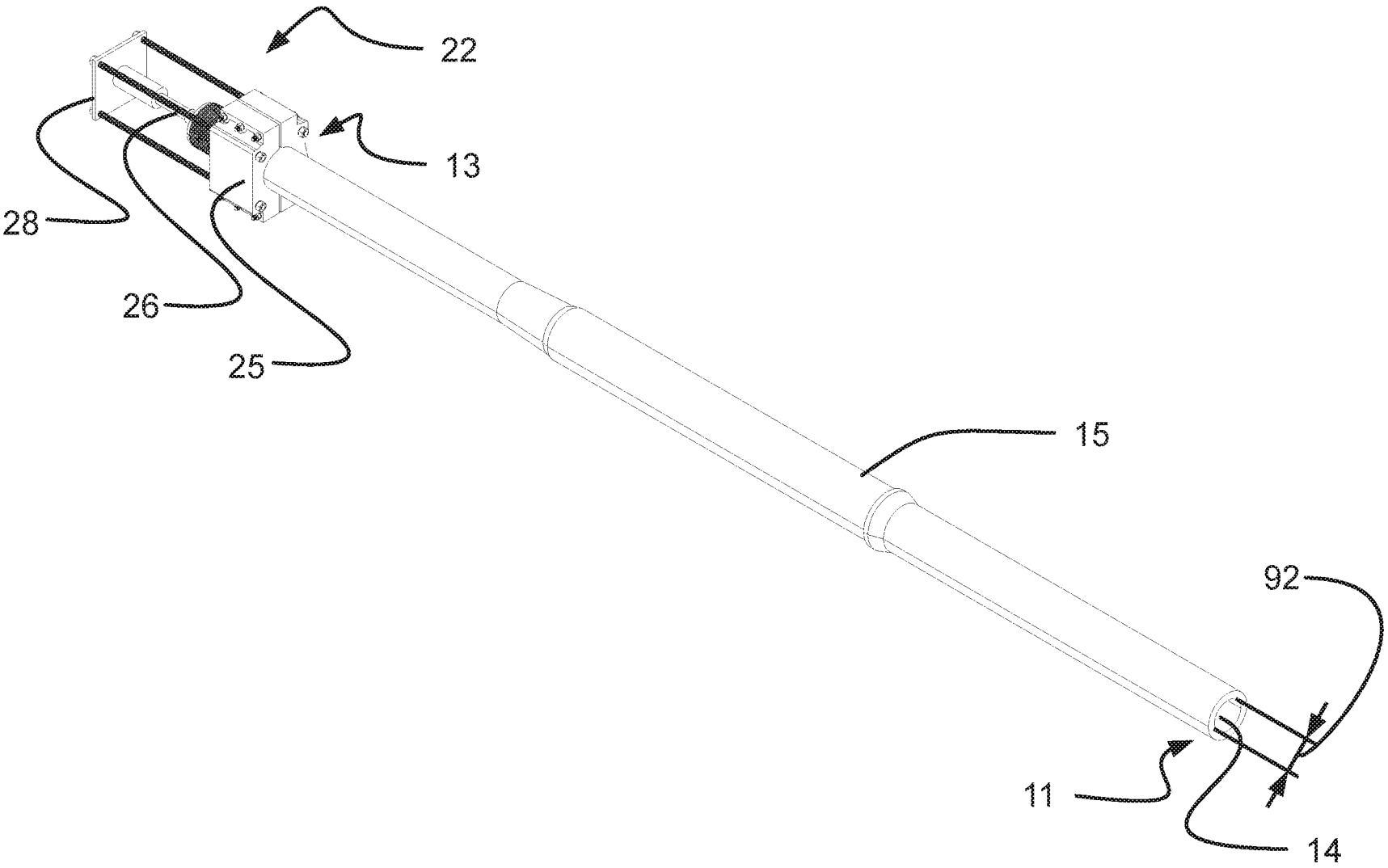
FIG. 1 illustrates an isometric view of an extraction system.

Reference will now be made to the examples illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, the term "distal" refers to a direction or orientation distant from a point of reference. For example, referring to an extraction system, a base can be used as a point of reference. Thus, a direction and position or point away from the base can be considered a distal direction or position or point. Similarly, an object or reference that is further away from the base than another object or reference can be considered distal.

As used herein, the term "proximal" refers to a direction or orientation towards a point of reference. For example, referring to an extraction system, a base can be used as a point of reference. Thus, a direction of position or point towards the base can be considered a proximal direction or position or point. Similarly, an object or reference that is closer to the base than another object or reference can be considered proximal.

An initial overview of the inventive concepts is provided below, and then specific examples are described in further detail later. This initial summary is intended to aid readers in understanding the examples more quickly but is not intended to identify key features or essential features of the examples, nor is it intended to limit the scope of the claimed subject matter.

In one example, disclosed is an extraction pole assembly for facilitating the removal of an object from a bore. The extraction pole assembly comprises a first extraction pole, a second extraction pole, and a centering coupler. The first and second extraction pole each have a distal end and a proximal end. The centering coupler comprises a spacer and an axial bar. The spacer comprises a central aperture and a partial spherical outer surface sized to complement an inner diameter of the bore housing the object to be removed. The axial bar is secured in the central aperture and comprises a proximal end coupled to the distal end of the first extraction pole and a distal end coupled to the proximal end of the second extraction pole.

In accordance with a more detailed aspect, the spacer can comprise a material having a low coefficient of friction and the axial bar comprises a rigid material.

In accordance with a more detailed aspect, the material having a low coefficient of friction can comprise nylon and the rigid material can comprise a metal.

In accordance with a more detailed aspect, the extraction pole assembly can further comprise a centering coupler adapter. The centering coupler adapter can comprise a second spacer and a second axial bar. The second spacer can have a central aperture and a partial spherical outer surface sized to complement the inner diameter of the bore. The second axial bar can be secured in the central aperture of the second spacer and can comprise a proximal end coupled to the distal end of the second extraction pole and a distal end having external threads configured to couple to an extractor.

In accordance with a more detailed aspect, the first extraction pole and the second extraction pole can each have a bore and the axial bar can have a reduced diameter portion at the proximal end and the distal end. The bore of the first and second extraction pole can be sized to receive the reduced diameter portion of the axial bar.

In accordance with a more detailed aspect, the first extraction pole can further comprise a surface formed in the distal end of the first extraction pole and that is normal to a longitudinal axis of the first extraction pole, the second extraction pole can further comprise a surface formed in the proximal end of the second extraction pole that is normal to a longitudinal axis of the second extraction pole, and the axial bar can have a first load bearing ledge formed in the proximal end between an outer surface of the axial bar and the reduced diameter portion and a second load bearing ledge formed in the distal end between the outer surface of the axial bar and the reduced diameter portion. The surface formed in the distal end of the first extraction pole can contact the first load bearing ledge and the surface formed in the proximal end of the second extraction pole can contact the second load bearing ledge, Also disclosed is a centering coupler for coupling extraction poles of an extraction pole assembly for extracting an object from a bore. The centering couple comprises a spacer and an axial bar. The spacer comprises a central aperture and a partial spherical outer surface sized to complement the bore. The axial bar is secured within the central aperture and comprises a first end, a second end, and a central portion. Each of the first and second end have a reduced diameter portion sized to couple to an extraction pole and a load bearing ledge formed between the reduced diameter portion and the central portion.

In accordance with a more detailed aspect, the spacer can have a central axis and be radially symmetric about the central axis.

In accordance with a more detailed aspect, the spacer can have a plurality of vent holes extending through the spacer.

In accordance with a more detailed aspect, the plurality of vent holes can be symmetrically arranged about a central axis of the spacer.

In accordance with a more detailed aspect, the partial spherical outer surface has a spherical diameter less than a length of the axial bar.

In accordance with a more detailed aspect, the spacer can comprise a first material and the axial bar can comprise a second material and the first material can have a lower coefficient of friction than the second material.

In accordance with a more detailed aspect, the spacer can comprise nylon and the axial bar can comprise aluminum.

In accordance with a more detailed aspect, the reduced diameter portion of each of the first and second end can have a length greater than a radius of the partial spherical outer surface.

Also disclosed is an extraction system for removing an object from a bore. The extraction system comprises a plurality of extraction poles, a plurality of centering couplers, and a press assembly. Each of the extraction poles has a proximal end and a distal end. Each of the centering couplers comprises a partial spherical outer surface sized to complement a diameter of the bore, a proximal end configured to couple to a distal end of an extraction pole, and a distal end configured to couple to a proximal end of the extraction pole. The press assembly comprises a clamp configured to secure to a structure having the bore and an extendable member configured to provide an input force to an extraction pole of the plurality of extraction poles.

In accordance with a more detailed aspect, the extraction system can further comprise a projectile extractor having a proximal end configured to couple to a distal end of a centering coupler and a distal end configured to engage a projectile.

In accordance with a more detailed aspect, each centering coupler of the plurality of centering couplers can comprise a spacer and an axial bar. The spacer can comprise the partial spherical outer surface and a central aperture. The axial bar can be axial bar secured within the central aperture and comprise a first and second end and a central portion. Each end of the first and second end can have a reduced diameter portion sized to couple to an extraction pole and a load bearing ledge formed between the reduced diameter portion and the central portion.

In accordance with a more detailed aspect, the partial spherical outer surface of each of the centering couplers can have a radius that is at least twice as large as an outer radius of each of the extraction poles.

In accordance with a more detailed aspect, each extraction pole can have a lateral aperture sized to receive a locking pin and each reduced diameter portion can have a lateral aperture sized to receive the locking pin.

In accordance with a more detailed aspect, the lateral aperture of each extraction pole can align with the lateral aperture of each reduced diameter portion when an end of an extraction pole placed over a reduced diameter portion and an end face of the extraction pole contacts a load bearing ledge of the reduced diameter portion.

Figure 3:
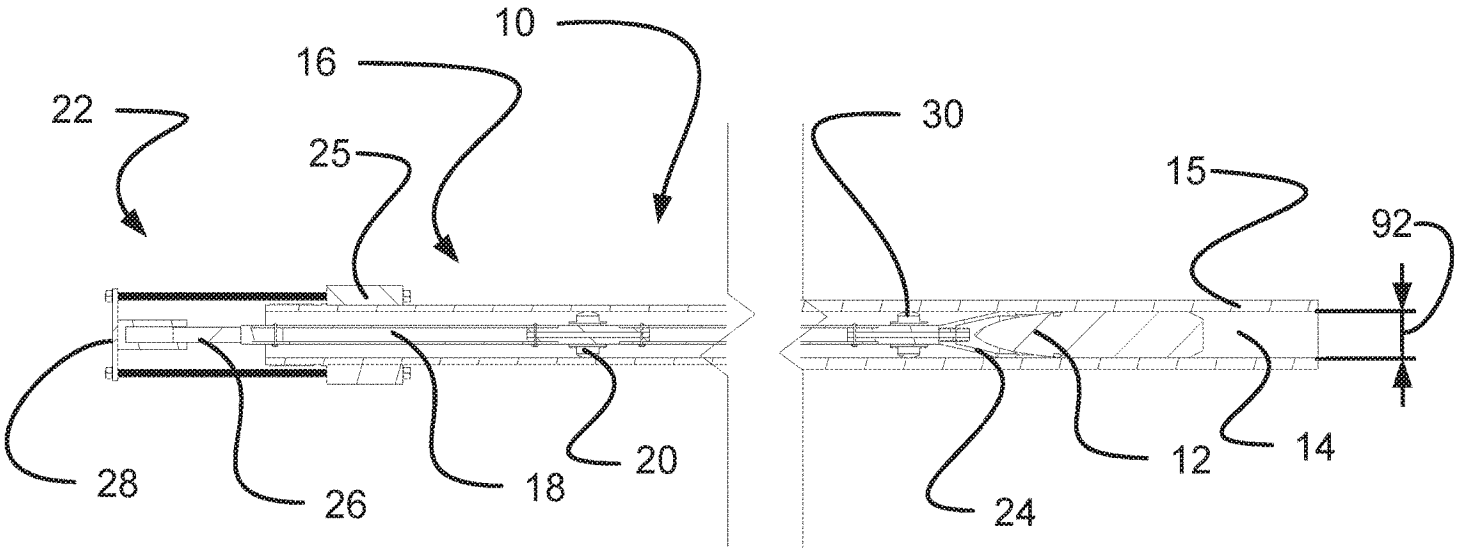
FIG. 3 illustrates a cross-sectional view of the extraction system of FIG. 1, taken about line AA of FIG. 2.
Figure 2:
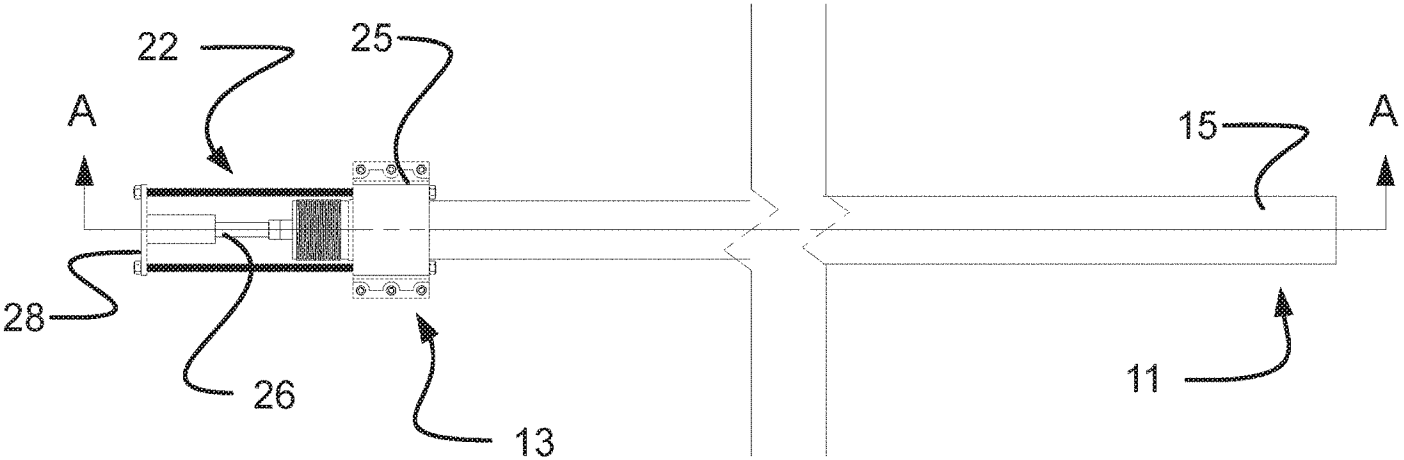
FIG. 2 illustrates a side view of the extraction system shown in FIG. 1.

To further describe the present technology, examples are now provided with reference to the figures. FIGS. 1-3 illustrate an example of an extraction system 10 for removing an object (e.g. projectile 12 in FIG. 3), from a bore 14 of a projectile firing device. The bore 14 can be any bore in which an object may be lodged. In the example of FIGS. 1-3, the bore 14 is a bore of a barrel 15 of a projectile firing device, such as a 155 mm projectile firing device (e.g., Howitzer, Advanced Gun System (AGS), and others), although the bore 14 can comprise a bore of a barrel of any type and size of projectile firing device (e.g., 105 mm, 152 mm, 175 mm, 203 mm, and other large caliber projectile firing devices, or smaller caliber projectile firing devices). The barrel 15 has a breech end 11 and a muzzle end 13. As shown in FIG. 3, the extraction system 10 can comprise an extraction pole assembly 16 comprising a plurality of extraction poles 18 and a plurality of centering couplers 20, and a press assembly 22. The extraction pole assembly 16 can be used with a variety of different projectile extraction presses. In one specific example, the extraction pole assembly 16 can be used with the projectile extraction press shown and described in U.S. patent application Ser. No. 16/739,062, filed Jan. 9, 2020, which is incorporated by reference in its entirety herein. In some examples, the extraction system 10 can further comprise a projectile extractor 24 for engaging the projectile 12.

Each of the extraction poles 18 can have a proximal end and a distal end. Again, the proximal and distal ends are with reference to the muzzle end 13. Thus, the proximal end is an end nearer the muzzle end 13 and the distal end is an end further away from the muzzle end, such as the breech end 11, with the extraction system in use within the barrel 15. The extraction poles 18 can each be the same or substantially similar to one another, though they need not be. For example, the extraction poles 18 can all be of the same length, or in some examples, the extraction poles 18 can vary in length. Each end of an extraction pole 18 can be the same or substantially similar, such that an extraction pole 18 can be used with either end in the distal or proximal orientation. As will be described hereafter, each end of an extraction pole 18 has an interface for coupling to a centering coupler 20 (or a projectile extractor (e.g., projectile extractor 24).

Each of the plurality of centering couplers 20 comprises a partial spherical outer surface (the barrel contacting surface) sized to fit within or complement an inner diameter 92 of the bore 14. Thus, when a centering coupler 20 is inserted within the bore 14, contact between the outer surface of the centering coupler 20 and the inner surface of the bore 14 keeps the centering coupler 20 and the extraction poles 18 centered within the bore 14. Because the outer barrel contacting surface of the centering coupler 20 is at least partially spherical, thus reducing the portion of the outer barrel contacting surface in contact with the barrel 15 (i.e., the spherical configuration providing somewhat of a point contact arrangement) the centering coupler 20 is able to slide within the bore 14 without binding, even if the centering coupler 20 is not axially aligned within the bore 14. The centering couplers 20 each have a distal end and a proximal end configured to couple to respective extraction poles 18. Each end of the centering couplers 20 can be substantially similar, such that a centering coupler 20 can be used with either end in a distal or proximal orientation.

Each centering coupler 20 is operable to couple a distal end of a proximal extraction pole and a proximal end of a distal extraction pole. When coupled to the extraction poles 18, the centering couplers 20 operate to keep the ends of the extraction poles 18 centered within the bore 14 while transmitting axial force through the extraction pole assembly 16. Because the centering couplers 20 center the ends of the extraction poles 18, the extraction pole assembly 16 is less likely to bow or otherwise deflect laterally when subjected to an axial force, such as the axial force(s) applied to remove or extract a projectile.

A proximal end of a proximal extraction pole of the extraction pole assembly 16 can be configured to interface with the press assembly 22 to receive an axial force. The press assembly 22 can press directly on a flat face of the proximal extraction pole, or as will be shown later, an adapter can be inserted between the press assembly 22 and the proximal extraction pole.

The press assembly 22 can comprise a clamp 25 configured to couple to the barrel 15, and an extendable member 26 configured to provide an input force to the extraction pole assembly 16. The press assembly 22 can have a base 28 offset from the clamp 25 and the extendable member 26 can be located between the base 28 and the clamp 25. Thus, as an operator extends the extendable member 26, it presses against the base 28 and the extraction pole assembly 16. Because the clamp 25 and the base 28 are coupled to the barrel 15, the extendable member 26 forces the extraction pole assembly 16 to move distally as the extendable member 26 expands. This axial force is transmitted through the extraction pole assembly 16 to the object (e.g., projectile) to be removed.

In some examples, the extraction pole assembly 16 can further comprise a projectile extractor 24 for interfacing with the projectile 12, for instance, to prevent damage to the projectile. The projectile extractor 24 can have an inner surface configured to interface with an outer surface of the projectile 12. The projectile extractor 24 can reduce damage that may otherwise be caused by the extraction system 10 pressing on the projectile 12. The projectile extractor 24 can couple to the extraction pole assembly 16 by way of a centering coupler 20, or a centering coupler adapter 30. For example, the projectile extractor 24 can have an interface that is substantially similar to an interface of an extraction pole 18. Thus, the projectile extractor 24 can couple directly to a centering coupler 20 in the same manner as an extraction pole 18. In other examples, the projectile extractor 24 can have a threaded interface. In such examples, as will be shown later, a centering coupler adapter 30 can have a complementary thread at a distal end and the same interface as a centering coupler 20 at the proximal end. Thus, the proximal end can couple to an extraction pole 18 and the distal end can couple to the projectile extractor 24.

Figure 4:
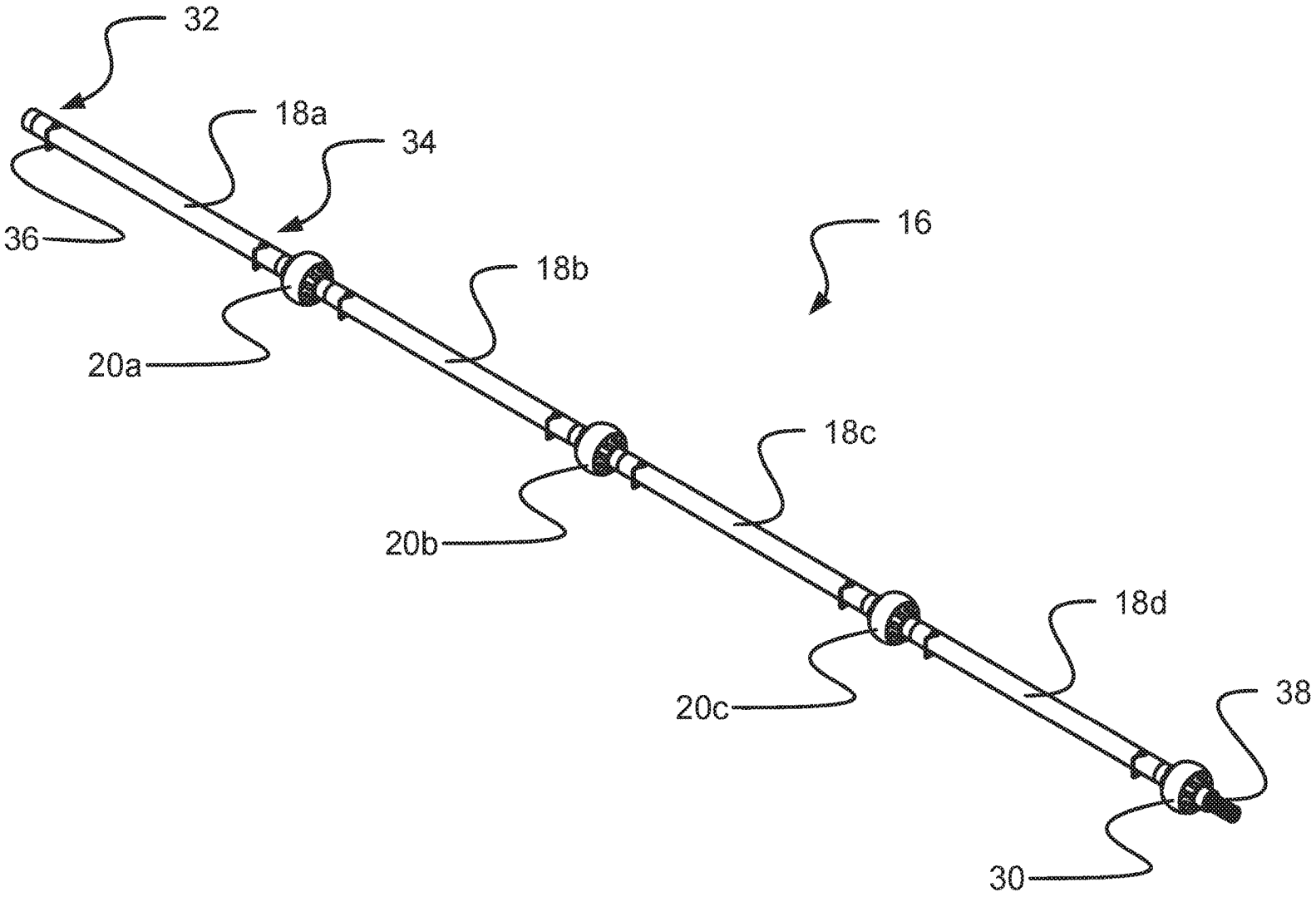
FIG. 4 illustrates an isometric view of an extraction pole assembly of the extraction system of FIG. 1.

FIG. 4 illustrates the extraction pole assembly 16 shown in FIGS. 1-3 separate from the press assembly 22 and the barrel 15. As in the example shown, the extraction pole assembly 16 can comprise a plurality of extraction poles (e.g., see the four extraction poles 18*a*, 18*b*, 18*c*, 18*d*), a plurality of centering couplers (e.g., see the three centering couplers 20*a*, 20*b*, 20*c*), and a centering coupler adapter 30. The extraction poles 18*a*, 18*b*, 18*c*, 18*d* can each have a proximal end 32 and a distal end 34 operable to couple with a centering coupler. Thus, each centering coupler 20*a*, 20*b*, 20*c* can be coupled between a distal end 34 of a first extraction pole (e.g. extraction pole 18*a*) and a proximal end 32 of a second extraction pole (e.g. extraction pole 18*b*). As will be described hereafter, each extraction pole can be secured to a respective centering coupler using a pin 36.

The proximal end 32 of the first extraction pole 18*a* can be configured to interface with the press assembly 22 of FIG. 1. For example, the proximal end 32 can receive a reduced diameter portion of a press arm configured to provide an axial force to the extraction pole assembly 16, or the proximal end 32 can receive an adapter having a reduced diameter portion for insertion in the proximal end 32.

The centering coupler adapter 30 is similar to the centering couplers 20, 20*b*, 20*c* and can have the same general configuration with the exception that a distal end can have a thread 38 for interfacing with the projectile extractor 24. For example, the projectile extractor 24 can have a proximal end having a thread for coupling to an extraction pole assembly and the centering coupler adapter 30 can have a complementary thread 38. Thus, the projectile extractor 24 can be coupled to the centering coupler adapter 30 by threading the projectile extractor 24 with the thread 38 of the centering coupler adapter 30.

Figure 5:
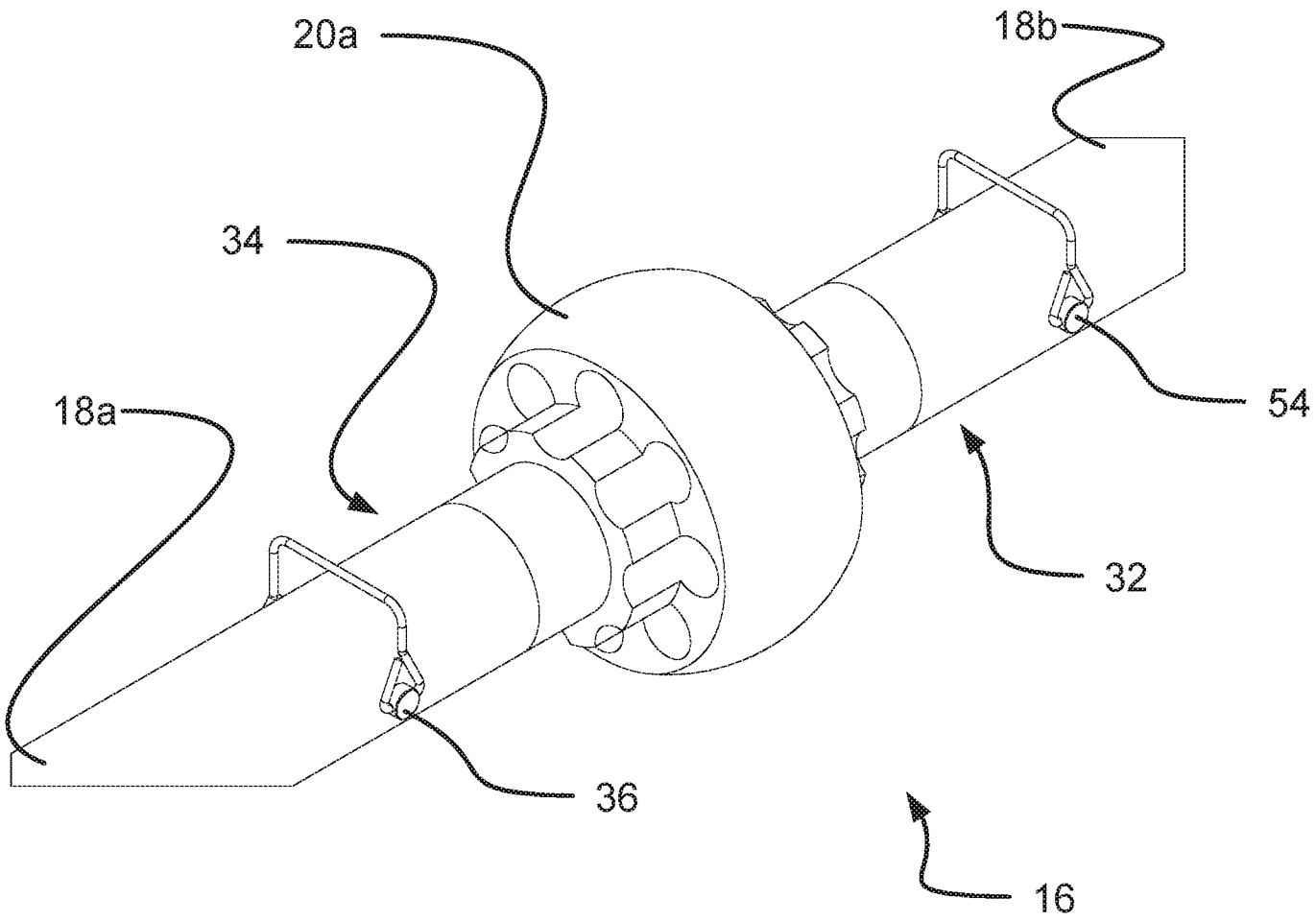
FIG. 5 illustrates a detailed, partial isometric view of the extraction pole assembly of FIG. 4.
Figure 7:
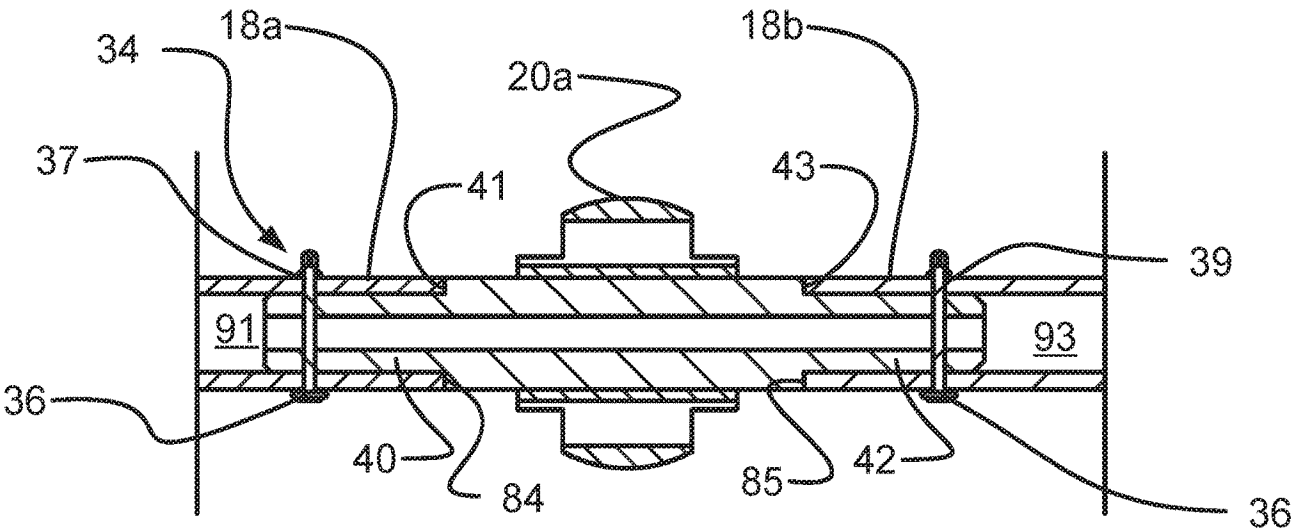
FIG. 7 illustrates a partial detailed, cross-sectional view of the extraction pole assembly of FIG. 4 taken about line BB of FIG. 6.
Figure 6:
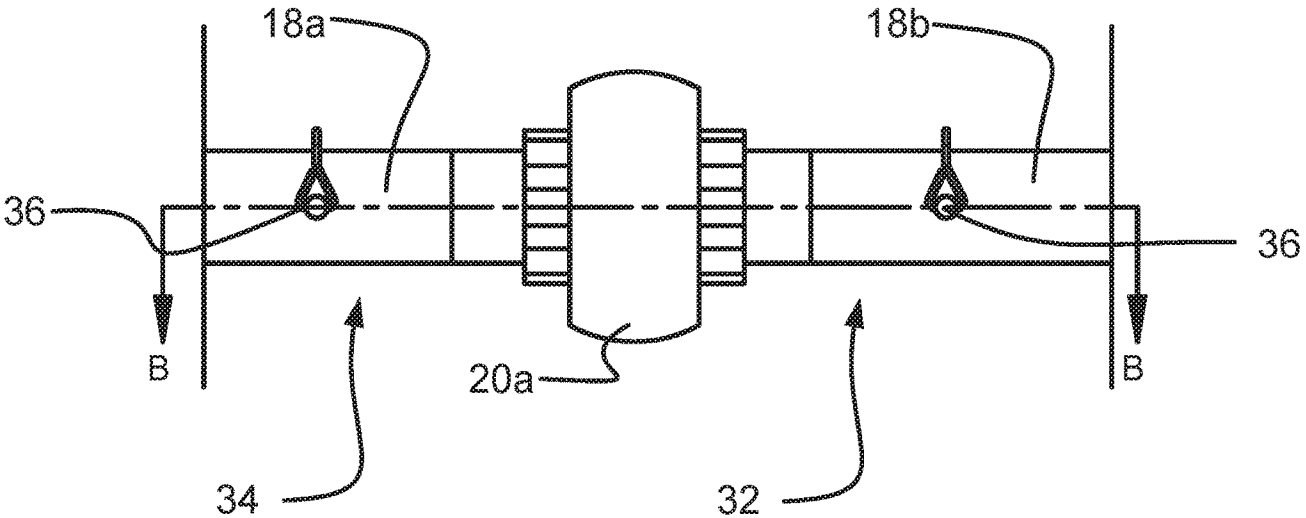
FIG. 6 illustrates a detailed, partial side view of the extraction pole assembly of FIG. 4.

FIGS. 5, 6, and 7 illustrate a detailed view of the extraction pole assembly 16 of FIGS. 1 and 4 showing the coupling of a first extraction pole 18*a* and a second extraction pole 18*b* by way of a centering coupler 20*a*. The first and second extraction poles 18*a* and 18*b* can each have a central aperture (e.g., see the central aperture 91 in the first extraction pole 18*a*, and the central aperture 93 in the second extraction pole 18*b*). When assembled, a distal end 34 of the first extraction pole 18*a* is positioned with a first reduced diameter portion 40 of the centering coupler 20*a* extending into the central aperture 91 of the first extraction pole 18*a* and a proximal end 32 of the second extraction pole 18*b* is positioned with a second reduced diameter portion 42 of the of the centering coupler 20*a* extending into the central aperture 93 of the second extraction pole 18*b*. Locking pins 36 pass through respective lateral apertures 37, 39 in the first and second extraction poles 18*a*, 18*b* and respective lateral apertures 46, 48 (see FIG. 8) in the first and second reduced diameter portions 40, 42 to secure the first and second extraction poles 18*a*, 18*b* to the centering coupler 20*a*.

The extraction poles 18*a*, 18*b* each have an end face (e.g., see respective end faces 41, 43). The end faces 41, 43 can have a surface that is substantially perpendicular to a central axis of the extraction pole assembly 16. The centering coupler 20*a* can have complementary load bearing ledges 84, 85. When assembled, and with the lateral apertures 37, 39 of the first and second extraction poles 18*a*, 18*b* aligned with the respective lateral apertures 46, 48 of the centering coupler 20*a*, the end faces 41, 43 of the respective extraction poles 18*a*, 18*b* can contact the complementary load bearing ledges 84, 85 of the centering coupler 20*a*. Thus, an axial force from the first extraction pole 18*a* can be transferred to the centering coupler 20*a* by the interaction of the end face 41 and the complementary load bearing ledge 84. The centering coupler 20*a* can the transfer the force to the second extraction pole 18*b* by the interaction of the complementary load bearing ledge 85 and the end face 43 to the second extraction pole 18*b*. Thus, the locking pins 36 do not (and are not required to) transfer the axial force between the components of the extraction pole assembly 16. In this arrangement, the locking pins 36 can be used simply to secure the various extraction poles to the various centering couplers (and/or the centering coupler adapter 20*a*) of the extraction pole assembly 16.

Figure 8:
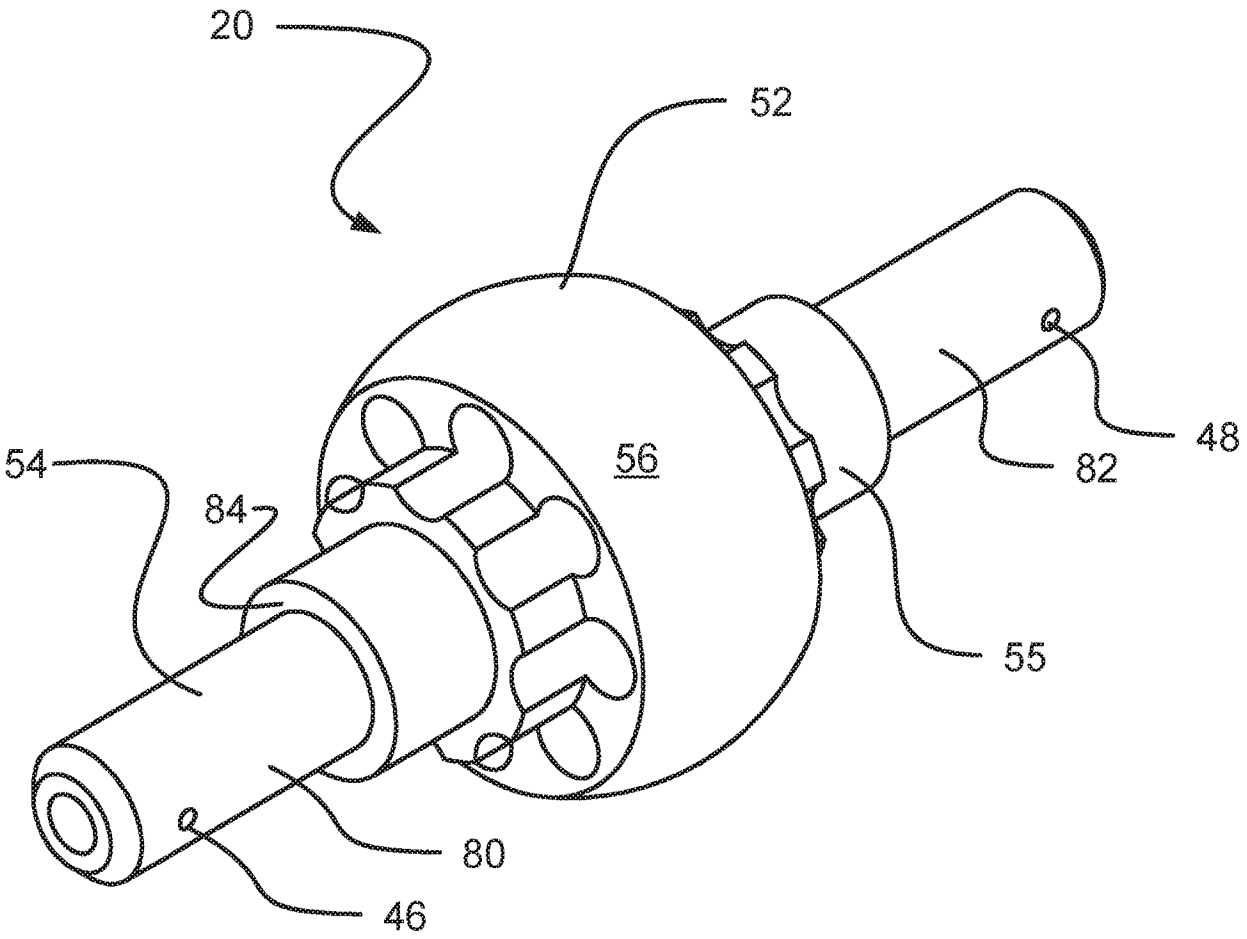
FIG. 8 illustrates an isometric view of a centering coupler of the extraction pole assembly of FIG. 4.
Figures 9, 10:
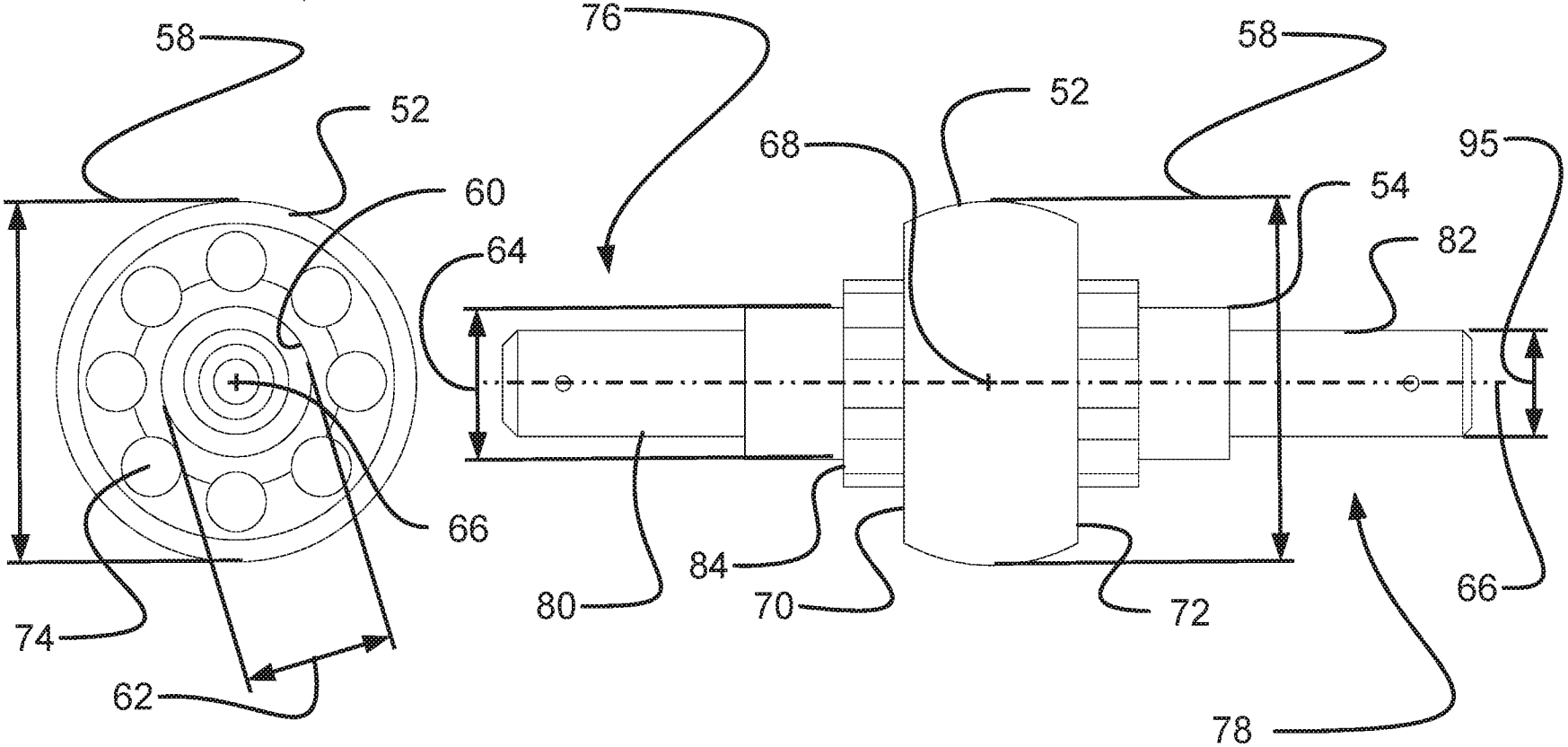
FIG. 9 illustrates an end view of the centering coupler illustrated in FIG. 8.
FIG. 10 illustrates a side view of the centering coupler illustrated in FIGS. 8 and 9.

FIG. 8 illustrates a centering coupler 20 in accordance with an example of the present disclosure. The centering coupler 20 can be used in the example of FIGS. 1-7 to couple extraction poles end to end to form the extraction pole assembly 16. Referring to FIGS. 8-10, the centering coupler 20 can comprise a spacer 52 and an axial bar 54. The spacer 52 can have a partial spherical outer surface 56 that has an outermost diameter 58 complementary to a minor inner diameter of a bore of a barrel containing the object to be removed (e.g., inner diameter 92 of bore 14 of barrel 15 of FIG. 1). For example, for a smooth bore, the outermost diameter 58 can be the same as or slightly less than the inner diameter of the smooth bore. In a grooved bore, or a rifled bore, the outermost diameter 58 can be the same or slightly less than a minimum distance between opposing protrusions, i.e. a minor diameter. The spacer 52 can have an aperture 60 sized to receive the axial bar 54. For example, the aperture 60 can have an inner diameter 62 that complements an outer diameter 64 of the axial bar 54. The axial bar 54 can be press fit within the aperture 60, or secured by other conventional means such as adhesives, pins, or vulcanizing material of the spacer 52 to the axial bar 54.

In the above example, the spacer 52 and the axial bar 54 are separate components that fit or couple together. However, this is not intended to be limiting in any way. Indeed, those skilled in the art will recognize that the spacer 52 and the axial bar 54 of the centering coupler 20 can be integrally formed (i.e., formed from the same material to comprise a single piece or component). In this example, a nylon or other low coefficient of friction material can be formed and supported about the outer surface of the spacer.

The spacer 52 can comprise a material having a relatively low coefficient of friction. Additionally, the spacer 52 can comprise a material that is softer than the material the bore is formed in. Thus, when the spacer 52 contacts the surface of the bore, there is little risk that the spacer 52 might damage the bore. In one example, the spacer 52 can be formed of a nylon material.

The axial bar 54 can be rigid and comprise a material having a relatively high coefficient of elasticity. Thus, the axial bar 54 does not substantially bend or deform when subjected to a force. In one example, the axial bar 54 can be formed of a lightweight metal, such as aluminum.

The aperture 60 can have a central axis 66 that coincides with a center 68 of the partial spherical outer surface 56 of the spacer 52. Thus, the axial bar 54 within the aperture 60 can be centered relative to the partial spherical outer surface 56 of the spacer 52. In some examples, the spacer 52 can be radially symmetric about the central axis 66. The spacer 52 can have a first lateral surface 70 and an opposing second lateral surface 72. The first and second lateral surfaces 70, 72 can be substantially perpendicular to the central axis 66. Vents can be formed in the spacer 52 to facilitate fluid within the bore, such as air, to pass through the centering coupler 20 as it advances through the bore, thus eliminating any positive or negative pressure situations within the bore as the extraction pole assembly 16 is bi-directionally displaced within the bore. In one example, the vents can comprise a one or more apertures 74 formed in the spacer 52 that extend between the first and second lateral surfaces 70, 72. As shown in FIG. 7, a plurality of apertures 74 can be symmetrically arranged about the central axis 66, but this is not intended to be limiting in any way.

The axial bar 54 can comprise a first end 76 and an opposing second end 78. A central portion 55 can be located between the first end 76 and the second end. Each of the first and second ends 76, 78 can have respective reduced diameter portions 80, 82. The reduced diameter portions 80, 82 can have an external diameter 95 sized to complement an inner diameter of an aperture (e.g. aperture 91 of FIG. 7) or bore of an extraction pole, as discussed above. As shown previously with respect to FIG. 7, an end of an extraction pole can be configured to slide over the reduced diameter portion of the axial bar until an end face of the extraction pole contacts a load bearing ledge (e.g. load bearing ledge 84) formed between the reduced diameter portion and the central portion 55 of the axial bar 54. The reduced diameter portion can provide lateral stability between the axial bar 54 and the extraction pole, while the load bearing ledge 84 transfers axial force from an extraction pole coupled to the first reduced diameter portion to an extraction pole coupled to the second reduced diameter portion.

Thus, the extraction system 10 shown in FIGS. 1-3 can be assembled using the extraction pole assembly 16 shown in FIGS. 4-7, which can in turn be assembled using the centering coupler 20 shown in FIGS. 8-10. The extraction system 10 allows an axial force to be transmitted axially through a bore to apply an axial force to an object within the bore. The extraction system 10 can transmit the axial force while reducing the chance of the extraction pole assembly 16 buckling through the use of the centering couplers 20, which keep the extraction pole assembly 16 centered within the bore.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. An extraction pole assembly for facilitating removal of an object from a bore of a structure, the extraction pole assembly comprising:

a first extraction pole having a distal end and a proximal end;

a second extraction pole having a distal end and a proximal end; and a centering coupler comprising:

a spacer comprising a partial spherical outer surface sized to be received within the bore of the structure; and an axial bar extending from the spacer, the axial bar comprising a proximal end coupled to the distal end of the first extraction pole and a distal end coupled to the proximal end of the second extraction pole, wherein the extraction pole assembly is slidable within the bore and relative to the structure.

2. The extraction pole assembly of claim 1, wherein the spacer comprises, at least in part, a material having a suitable coefficient of friction to facilitate relative movement between the spacer and the bore, and the axial bar comprises a rigid material.

3. The extraction pole assembly of claim 2, wherein the material comprises nylon and the rigid material comprises a metal.

4. The extraction pole assembly of claim 1, further comprising a centering coupler adapter comprising:

a second spacer having a central aperture and a partial spherical outer surface sized to complement the inner diameter of the bore; and a second axial bar secured in the central aperture of the second spacer, the second axial bar comprising a proximal end coupled to the distal end of the second extraction pole and a distal end having external threads configured to couple to an extractor.

5. The extraction pole assembly of claim 1, wherein the first extraction pole and the second extraction pole each have a bore and the axial bar has a reduced diameter portion at the proximal end and the distal end, wherein the bore of the first and second extraction pole is sized to receive the reduced diameter portion of the axial bar.

6. The extraction pole assembly of claim 5, wherein the first extraction pole further comprises a surface formed in the distal end of the first extraction pole and that is normal to a longitudinal axis of the first extraction pole, the second extraction pole further comprises a surface formed in the proximal end of the second extraction pole that is normal to a longitudinal axis of the second extraction pole, and the axial bar has a first load bearing ledge formed in the proximal end between an outer surface of the axial bar and the reduced diameter portion and a second load bearing ledge formed in the distal end between the outer surface of the axial bar and the reduced diameter portion, wherein the surface formed in the distal end of the first extraction pole contacts the first load bearing ledge and the surface formed in the proximal end of the second extraction pole contacts the second load bearing ledge.

7. A centering coupler for coupling extraction poles of an extraction pole assembly for extracting an object from a bore, the centering coupler comprising:

a spacer comprising a partial spherical outer surface sized to be received within a bore of a structure; and an axial bar extending from the spacer, the axial bar comprising first and second ends and a central portion, each of the first and second ends comprising an extraction pole interface operable to couple the centering coupler to respective extraction poles extending in opposing directions from each of the first and second ends.

8. The centering coupler of claim 7, wherein the spacer has a central axis and is radially symmetric about the central axis.

9. The centering coupler of claim 7, wherein the spacer has a plurality of vent holes extending through the spacer.

10. The centering coupler of claim 9, wherein the plurality of vent holes are symmetrically arranged about a central axis of the spacer.

11. The centering coupler of claim 7, wherein the partial spherical outer surface has a spherical diameter less than a length of the axial bar.

12. The centering coupler of claim 7, wherein the spacer comprises a first material and the axial bar comprises a second material, wherein the first material has a lower coefficient of friction than the second material.

13. The centering coupler of claim 7, wherein the spacer comprises nylon and the axial bar comprises metal.

14. The centering coupler of claim 7, wherein the extraction pole interface of each of the first and second ends comprises a reduced diameter portion having a length greater than a radius of the partial spherical outer surface.

15. The centering coupler of claim 7, wherein the spacer and the axial bar are separate components, the spacer comprising a central aperture, and the axial bar retained within the central aperture of the spacer.

16. An extraction system for removing an object from a bore of a structure, the extraction system comprising:

a plurality of extraction poles, each extraction pole having a proximal end and a distal end;

a plurality of centering couplers, each centering coupler of the plurality of centering couplers comprising a partial spherical outer surface sized to complement a diameter of the bore of the structure, a proximal end configured to couple to a distal end of a first extraction pole of the plurality of extraction poles, and a distal end configured to couple to a proximal end of a second extraction pole of the plurality of extraction poles, the plurality of extraction poles and the plurality of centering couplers forming, at least in part, an extraction pole assembly; and a press assembly comprising a clamp configured to secure to the structure having the bore and an extendable member configured to provide an input force to an extraction pole of the plurality of extraction poles to displace the extraction pole assembly within the bore and relative to the structure.

17. The extraction system of claim 16, further comprising a projectile extractor having a proximal end configured to couple to a distal end of a centering coupler and a distal end configured to engage a projectile.

18. The extraction system of claim 16, wherein each centering coupler of the plurality of centering couplers comprises:

a spacer comprising the partial spherical outer surface; and an axial bar extending from the spacer, and comprising a first and second end and a central portion, each end of the first and second end having a reduced diameter portion sized to couple to an extraction pole and a load bearing ledge formed between the reduced diameter portion and the central portion.

19. The extraction system of claim 18, wherein each extraction pole has a lateral aperture sized to receive a locking pin and each reduced diameter portion has a lateral aperture sized to receive the locking pin.

20. The extraction system of claim 19, wherein the lateral aperture of each extraction pole aligns with the lateral aperture of each reduced diameter portion when an end of an extraction pole placed over a reduced diameter portion and an end face of the extraction pole contacts a load bearing ledge of the reduced diameter portion.

21. The extraction system of claim 16, wherein the partial spherical outer surface of each of the centering couplers has a radius that is at least twice as large as an outer radius of each of the extraction poles.

* * * * *